US007109952B2

(12) United States Patent
Kwon

(10) Patent No.: US 7,109,952 B2
(45) Date of Patent: Sep. 19, 2006

(54) LIGHT EMITTING DISPLAY, LIGHT EMITTING DISPLAY PANEL, AND DRIVING METHOD THEREOF

(75) Inventor: Oh-Kyong Kwon, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 320 days.

(21) Appl. No.: 10/457,730

(22) Filed: Jun. 10, 2003

(65) Prior Publication Data

US 2003/0227262 A1 Dec. 11, 2003

(30) Foreign Application Priority Data

Jun. 11, 2002 (KR) ..... 10-2002-0032676
Mar. 21, 2003 (KR) ..... 10-2003-0017838

(51) Int. Cl.
*G09G 3/30* (2006.01)

(52) U.S. Cl. ..... 345/76; 345/82; 345/90

(58) Field of Classification Search ..... 345/76, 345/82, 90, 204, 92; 315/169.1–169.4
See application file for complete search history.

(56) References Cited

U.S. PATENT DOCUMENTS 6,091,203 A * 7/2000 Kawashima et al. ..... 315/169.3
6,229,506 B1 * 5/2001 Dawson et al. ..... 345/82
2004/0239599 A1 * 12/2004 Koyama ..... 345/76

* cited by examiner

*Primary Examiner*—Regina Liang
(74) *Attorney, Agent, or Firm*—H.C. Park & Associates, PLC

(57) ABSTRACT

A driving transistor for outputting a current for driving an organic electroluminescent (EL) element is formed on a pixel circuit of an organic EL display. A first capacitor is coupled between a power supply voltage and a gate of the driving transistor, and a second capacitor is coupled between the gate and a scan line. First a voltage matched with a data current is stored in the first capacitor in response to a select signal from the scan line. The voltage of the first capacitor is changed by variation of the select signal's voltage level. A driving current is output from the transistor because of the changed voltage of the first capacitor, and the organic EL element emits light as a result of the driving current.

21 Claims, 17 Drawing Sheets

LIGHT EMITTING DISPLAY, LIGHT EMITTING DISPLAY PANEL, AND DRIVING METHOD THEREOF

CROSS REFERENCE TO RELATED APPLICATION

This application claims priority to and the benefit of Korean Patent Application 2002-32676 filed on Jun. 11, 2002 and Korean Patent Application 2003-17838 filed on Mar. 21, 2003 in the Korean Intellectual Property Office, the content of which are incorporated herein in their entirety by reference.

BACKGROUND OF THE INVENTION

1. Field of the Invention

The present invention relates to an organic electroluminescence (EL) light emitting display, a light emitting display panel, and a driving method thereof 2. Description of the Related Art An organic EL display is a display that emits light by electrical excitation of fluorescent organic compounds and an image is displayed by driving each of M×N organic luminescent cells with voltage or current.

This organic cell includes an anode, an organic thin film and, a cathode layer. The anode may be formed, for example, of indium tin oxide (ITO) and the cathode may be formed, for example, of a metal. The organic thin film is formed as a multi-layered structure including an emission layer ("EML"), an electron transport layer ("ETL"), and a hole transport layer ("HTL") so as to increase luminescence efficiency by balancing electron and hole concentrations. In addition, it can include an electron injection layer ("EIL") and a hole injection layer ("HIL") separately.

Organic EL displays that have such organic luminescent cells are configured as passive matrix configuration or active matrix configuration. The active matrix configuration includes thin film transistors (TFTs) or MOSFETs. In the passive matrix configuration, organic luminescent cells are formed between anode lines and cathode lines that cross each other and the organic luminescent cells are driven by driving the anode and cathode lines. While in the active matrix configuration, each organic luminescent cell is connected to a TFT usually through an ITO electrode and is driven by controlling the gate voltage of the corresponding TFT. The active matrix method may be classified as a voltage programming method and/or a current programming method depending on the format of signals that are applied to the capacitor so as to maintain the voltage.

Referring to FIGS. 2 and 3, a conventional organic EL display of the voltage and current programming methods will be described.

FIG. 2 illustrates a pixel circuit following the conventional voltage programming method for driving an organic EL element. FIG. 2 illustrates one of the N×M pixels as a representative. A transistor M1 is coupled to an organic EL element OLED to supply the current for emission. The current of the transistor M1 is controlled by the data voltage applied through a switching transistor M2. A capacitor C1 for maintaining the applied voltage for a predetermined time is coupled between a source of the transistor M1 and a gate thereof. A gate of the switching transistor M2 is coupled to a scan line $S_n$, and a source thereof is coupled to a data line $D_m$. When the switching transistor M2 is turned on according to a select signal applied to the gate of the switching transistor M2, a data voltage from the data line $D_m$ is applied to the gate of the transistor M1. The current $I_{OLED}$ flows to the switching transistor M2 depending, for example, on the voltage $V_{GS}$ charged between the gate and the source by the capacitor C1, and the organic EL element OLED emits light depending, for example, on the current $I_{OLED}$. In this case, the current $I_{OLED}$ flowing to the organic EL element OLED is expressed in Equation 1.

Equation 1:

$$I_{OLED} = \frac{\beta}{2}(V_{GS} - V_{TH})^2 = \frac{\beta}{2}(V_{DD} - V_{DATA} - |V_{TH}|)^2$$

where $I_{OLED}$ is a current flowing to the organic EL element OLED, $V_{GS}$ is a voltage between the source and the gate of the transistor M1, $V_{TH}$ is a threshold voltage at the transistor M1, $V_{DATA}$ is a data voltage, and β is a constant.

As expressed in Equation 1, the current corresponding to the applied data voltage is applied to the organic EL element OLED, and the organic EL element emits light in relation to the applied current in the pixel circuit. The applied data voltage has multiple-stage values within a predetermined range so as to display different gray scales.

However, it is difficult for the conventional pixel circuit of the voltage programming method to obtain a wide spectrum of gray scales because of deviations of the threshold voltage $V_{TH}$ of the TFT and electron mobility caused by non-uniformity in the manufacturing process. For example, for driving a TFT in the pixel circuit by supplying a 3V voltage, the voltage is to be applied to the gate of the TFT each 12 mV (=3V/256) interval to express 8-bit (256) grays. If the deviation of the threshold voltage at the TFT caused by the non-uniformity of the manufacturing process is greater than 100 mV, it becomes difficult to express a wide spectrum of gray scales. It is also difficult to express a wide spectrum of gray scales because β in Equation 1 becomes differentiated due to deviation of the electron mobility.

However, if the current source can supply substantially uniform current to the pixel circuit over the whole data line, the pixel circuit of the current programming method generates uniform display characteristics even when a driving transistor in each pixel has non-uniform voltage-current characteristics.

FIG. 3 shows a conventional pixel circuit of the current programming method for driving an organic EL element, illustrating one of the N×M pixels as an example. In FIG. 3, a transistor M1 is coupled to an organic EL element OLED to supply the current for emission to the OLED, and the current of the transistor M1 is set to be controlled by the data current applied through a transistor M2.

First, when the transistors M2 and M3 are turned on according to a select signal from a scan line $S_n$, the transistor M1 is diode-connected, and a voltage corresponding to the data current $I_{DATA}$ from the data line $D_m$ is stored in the capacitor C1. Next, the select signal from the scan line $S_n$ becomes a high level voltage to turn off the transistors M2 and M3, and an emit signal from a scan line $E_n$ becomes a low level voltage to turn on the transistor M4. Power is then supplied from the power supply voltage VDD, and the current corresponding to the voltage stored in the capacitor C1 flows to the organic EL element OLED to emit light. In this case, the current flowing to the organic EL element OLED is expressed in Equation 2.

Equation 2:

$$I_{OLED} = \frac{\beta}{2}(V_{GS} - V_{TH})^2 = I_{DATA}$$

where $V_{GS}$ is a voltage between the source and the gate of the transistor M1, $V_{TH}$ is a threshold voltage at the transistor M1, and β is a constant.

As expressed in Equation 2, because the current $I_{OLED}$ flowing to the organic EL element is matched with the data current $I_{DATA}$ in the conventional current pixel circuit, an organic EL panel has substantially uniform characteristics when a programming current source is uniform over the organic EL panel. However, because the current $I_{OLED}$ flowing to the organic EL element is a micro-current, it problematically takes a lot of time to charge the data line in order to control the pixel circuit using the micro-current $I_{DATA}$. For example, if the load capacitance of the data line is 30 pF, it takes several milliseconds to charge the load of the data line with the data current of about several tens to several hundreds nA. Taking a long time to charge the data line is problematic because the charging time is not sufficient (i.e., too long) when considering the data line time of several tens of μs.

SUMMARY OF THE INVENTION

The present invention provides a light emitting device for compensating for a threshold voltage and electron mobility of a transistor for fully charging a data line.

This invention separately provides a light emitting display including a plurality of data lines for transmitting a data current that displays a video signal, a plurality of scan lines for transmitting a select signal, and a plurality of pixel circuits each of which is formed at a pixel generated by the data lines and the scan lines, wherein the pixel circuit comprises a light emitting element for emitting light based on an applied current, a first transistor for supplying a driving current for emitting the light emitting element, a first switching element for transmitting a data signal from the data line associated with the pixel circuit in response to the select signal from the scan line associated with the pixel circuit, a second switching element for diode-connecting the first transistor in response to a first level of a first control signal, a first storage element for storing a first voltage matched with the data current from the first switching element according to the first level of the first control signal, a second storage element coupled between the first storage element and a signal line for supplying the first control signal, for converting the first voltage of the first storage element into a second voltage through coupling to the first storage element when the first level of the first control signal is switched to a second level, and a third switching element for transmitting the driving current to the light emitting element in response to the second control signal, the driving current being output from the first transistor according to the second voltage.

In various embodiments of the present invention, the second switching element is coupled between a second main electrode of the first transistor and the control electrode of the first transistor, or between the data line and a second main electrode of the first transistor.

This invention separately provides a method for driving a light emitting display having a pixel circuit including a first switching element for transmitting a data current from a data line in response to a select signal from a scan line, a transistor for outputting a driving current, a first storage element coupled between a first main electrode of the transistor and a control electrode of the transistor, and a light emitting element for emitting light in correspondence to the driving current from the transistor. The method comprises diode-connecting the transistor using a control signal at a first level, and setting a control electrode voltage of the transistor as a first voltage in correspondence to the data current from the first switching element, interrupting the data current, applying the control signal at a second level to a second end of a second storage element having a first end coupled to a control electrode of the transistor, and changing the control electrode voltage of the transistor to a second voltage through coupling of the first and second storage elements, and applying the driving current output from the transistor to the light emitting element in response to the second voltage.

This invention separately provides a display panel of a light emitting display including a plurality of data lines for transmitting a data current for displaying a video signal, a plurality of scan lines for transmitting a select signal, and a plurality of pixel circuits each of which is generated at a pixel generated by the data line and the scan line. The pixel circuit comprises a light emitting element for emitting light in correspondence to an applied current, a first transistor, having a first main electrode coupled to a first signal line for supplying a power supply voltage, for outputting a current for driving the light emitting element, a first switching element for transmitting a data current from the data line to the first transistor in response to the select signal from the scan line, a second switching element for diode-connecting the first transistor in response to a first level of a first control signal, a third switching element for transmitting a driving current from the transistor to the light emitting element in response to a second control signal; a first storage element coupled between a control electrode of the first transistor and a first main electrode of the first transistor, and a second storage element coupled between the control electrode of the first transistor and a second signal line for supplying the first control signal.

The display panel operates in a first interval in which the first transistor is diode-connected by the first control signal at the first level, and the data current is transmitted to the first transistor by the select signal, and a second interval in which the data current is interrupted, the first control signal is changed to a second level, a level variation of the first control signal is reflected to control electrodes of the first transistor according to coupling by the first and second storage elements, and the driving current is transmitted to the light emitting element by the second control signal.

These and other features and advantages of this invention are described in, or are apparent from, the following detailed description of various exemplary embodiments of the systems and methods according to this invention.

BRIEF DESCRIPTION OF THE DRAWINGS

The accompanying drawings, which are incorporated in and constitute a part of the specification, illustrate exemplary embodiments of the invention, and, together with the description, serve to explain the principles of the invention.

DETAILED DESCRIPTION OF THE EXEMPLARY EMBODIMENTS

Figure 1:
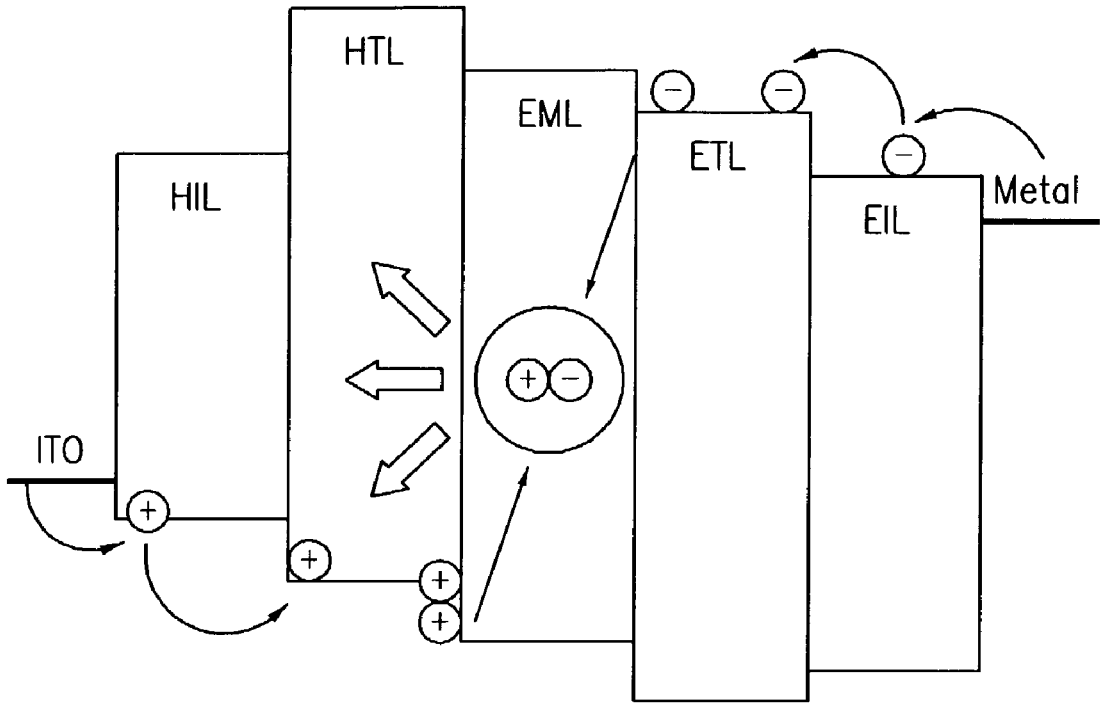
FIG. 1 shows a concept diagram of an organic EL element.
Figure 2:
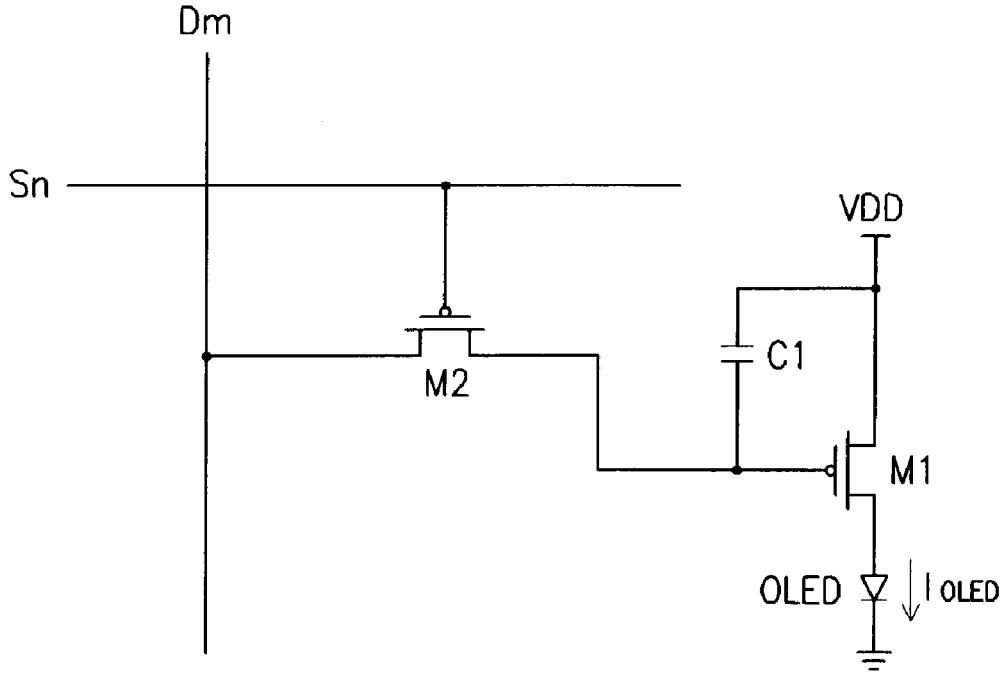
FIG. 2 shows a circuit of a conventional pixel circuit following a voltage driving method.
Figure 3:
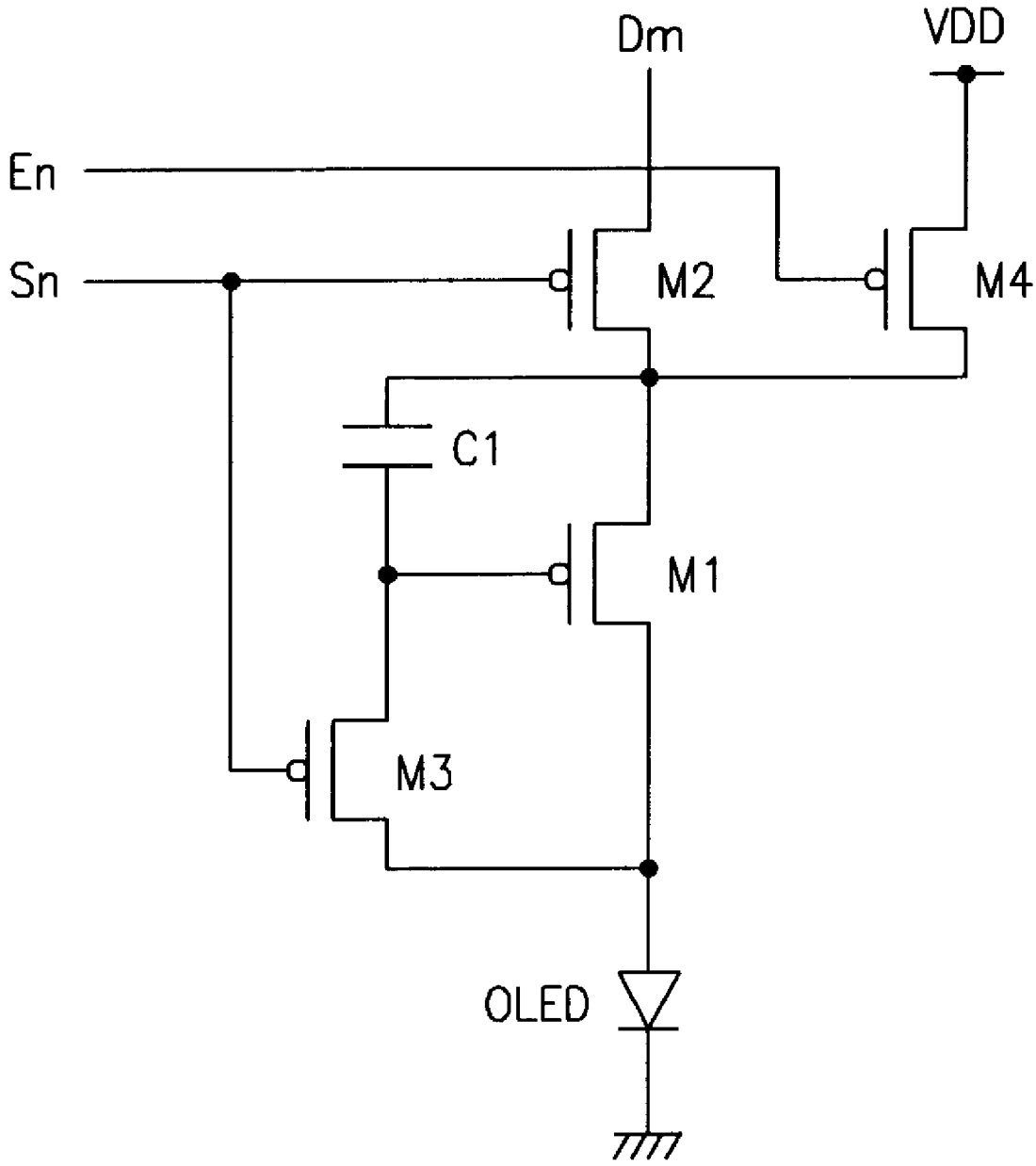
FIG. 3 shows a circuit of a conventional pixel circuit following a current programming method.

In the following detailed description, only exemplary embodiments of the invention have been shown and described. As will be realized, the invention is capable of modification in various obvious respects, all without departing from the invention. Accordingly, the drawings and description are to be regarded as illustrative in nature, and not restrictive.

To clearly describe the various exemplary embodiments of the present invention, portions that are not related to the description are omitted in the drawings. Also, in the following description, similar features of the various exemplary embodiments have identical reference numerals. Further, it should be understood that in the following description, coupling of a first portion to a second portion includes direct coupling of the first portion to the second portion, and coupling of the first portion to the second portion through a third portion provided between the first and second portions. Also, a reference numeral of a signal applied to a pixel circuit through each scan line is matched with that of the scan line for ease of description.

Figure 4:
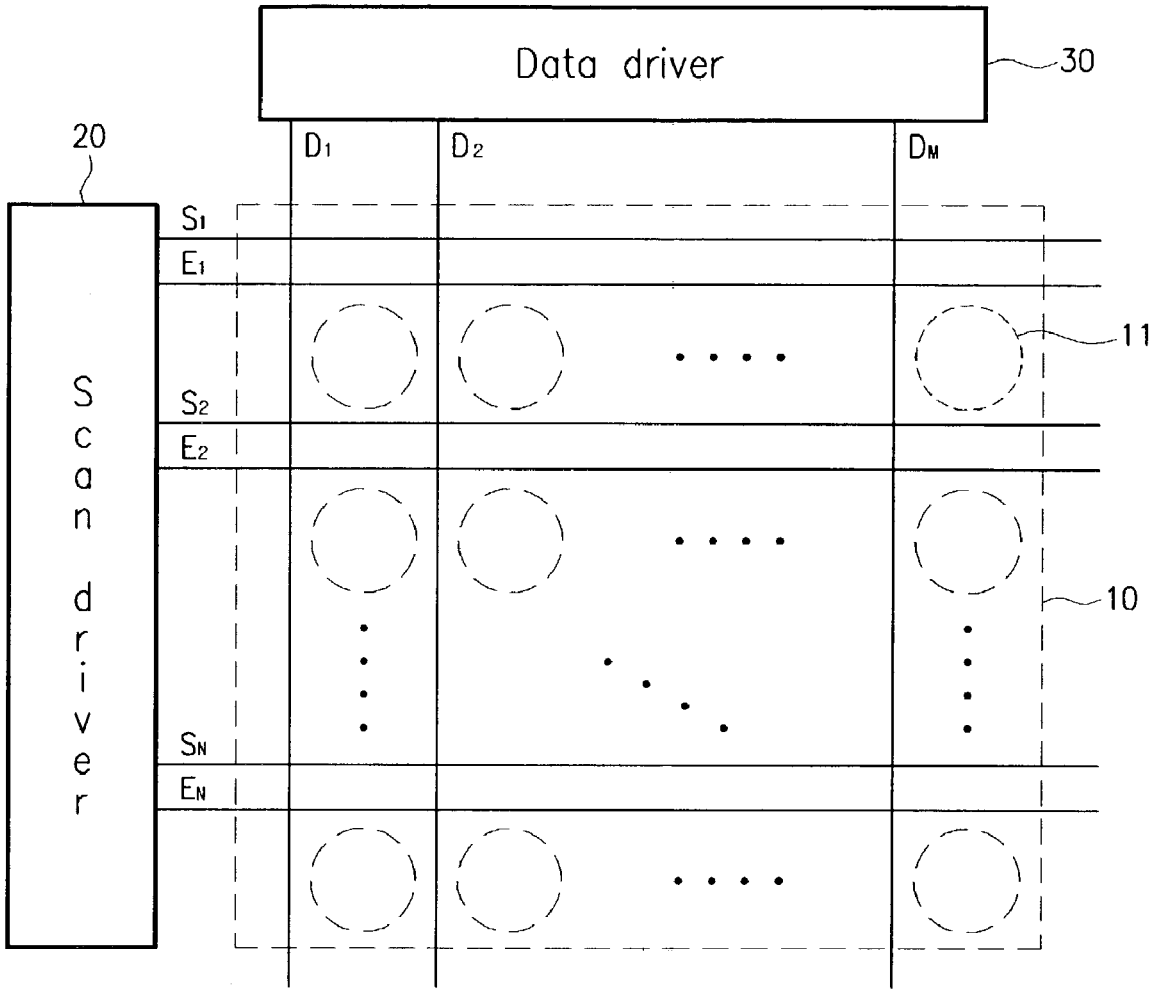
FIG. 4 shows a brief schematic diagram of an organic EL display according to an exemplary embodiment of the present invention.

FIG. 4 shows a brief schematic diagram of an organic EL display according to a first exemplary embodiment of the present invention. The organic EL display shown in FIG. 4 comprises an organic EL display panel 10, a scan driver 20, and a data driver 30. The organic EL display panel 10 comprises a plurality of data lines $D_1$–$D_M$ arranged in the row direction; a plurality of scan lines $S_1$–$S_N$ and $E_1$–$E_N$ arranged in the column direction; and a plurality of pixel circuits 11. The data lines $D_1$–$D_M$ transmit the data current for displaying video signals to the pixel circuits 11. The scan lines $S_1$–$S_N$ transmits the select signal to the pixel circuits 11, and the scan lines $E_1$–$E_N$ transmit emit signals to the pixel circuit 11. A pixel circuit 11 is formed at a pixel region defined by two adjacent data lines and two adjacent scan lines. More particularly, for example, a pixel region is defined by the region corresponding to a portion of the space between to two adjacent data lines which overlap a space between scan lines.

To drive the pixel circuits 11, the data driver 30 applies the data current to the data lines $D_1$–$D_M$, and the scan driver 20 respectively applies a select signal and an emit signal to the scan lines $S_1$–$S_N$ and the scan lines $E_1$–$E_N$ sequentially.

Next, referring to FIG. 5, a pixel circuit 11 of the organic EL display according to the first exemplary embodiment of the present invention will be described. For ease of description, FIG. 5 only shows the pixel circuit coupled to the $m^{th}$ data line $D_m$ and the $n^{th}$ scan line $S_n$.

Figure 5:
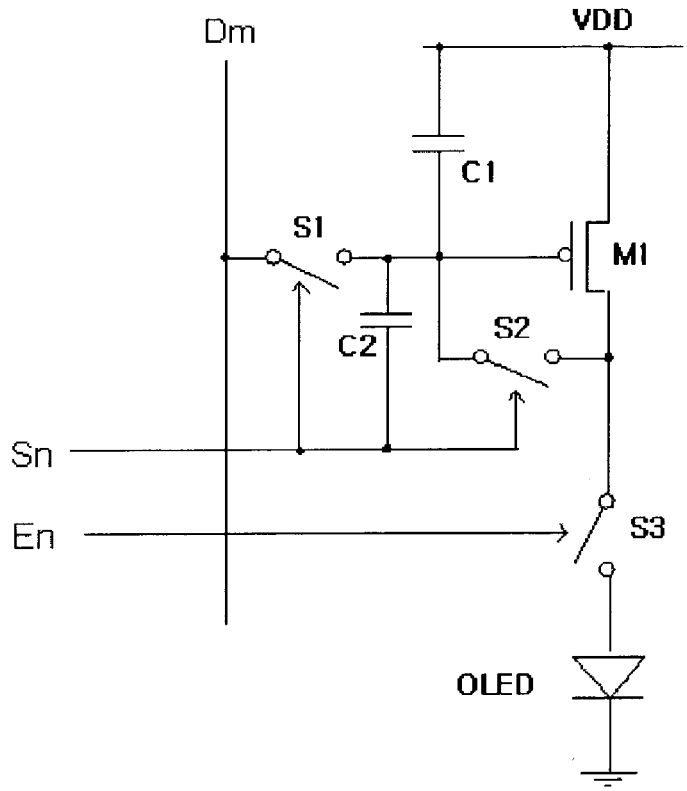
FIGS. 5, 6, 8, 9, 11, 12, 13, 15, 17, 19, 21, 22, 23, and 25 respectively show equivalent circuit diagrams of a pixel circuit according to various exemplary embodiments of the present invention.

As shown in FIG. 5, the pixel circuit 11 comprises an organic EL element OLED, a transistor M1, switches S1, S2, and S3, and capacitors C1 and C2. In this exemplary embodiment, the transistor M1 may be, for example, a PMOS transistor. The switch S1 is coupled between the data line $D_m$ and the gate of the transistor M1, and transmits the data current $I_{DATA}$ provided from the data line $D_m$ to the transistor M1 in response to the select signal provided from the scan line $S_n$. The switch S2 is coupled between the drain and the gate of the transistor M1, and diode-connects the transistor M1 in response to the select signal from the scan line $S_n$.

The transistor M1 has a source coupled to the power supply voltage VDD, and a drain coupled to the switch S3. The gate-source voltage of the transistor M1 is determined in relation to the data current $I_{DATA}$, and the capacitor C1 is coupled between the gate and the source of the transistor M1 to help maintain the gate-source voltage of the transistor M1 for a predetermined time. The capacitor C2 is coupled between the scan line $S_n$ and the gate of the transistor M1 to help control the voltage at the gate of the transistor M1. The switch S3 applies the current flowing to the transistor M1 to the organic EL element OLED in response to the emit signal provided from the scan line $E_n$. The organic EL element is coupled between the switch S3 and a reference voltage, and the organic EL element emits light matched with the current flowing to the transistor M1, which is substantially equal to the current $I_{OLED}$ applied to the organic EL element OLED when the switch S3 is closed.

Figure 6:
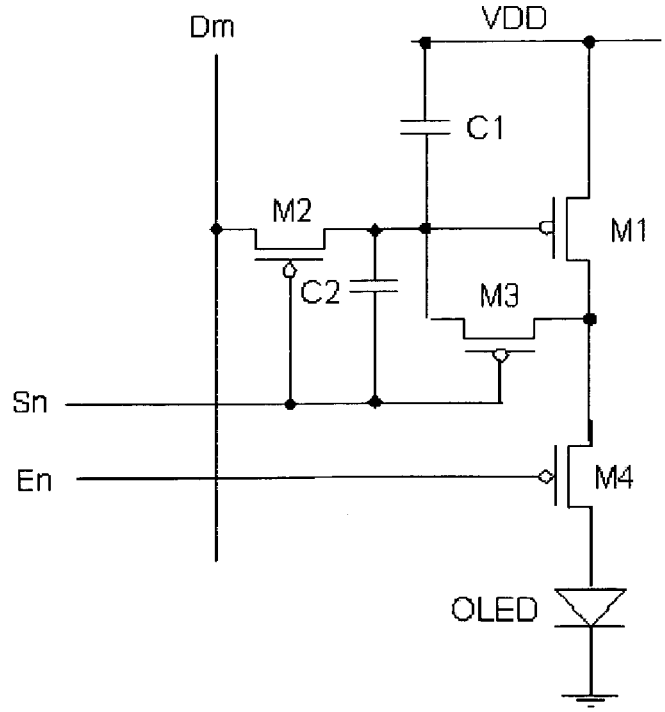
Figure 7:
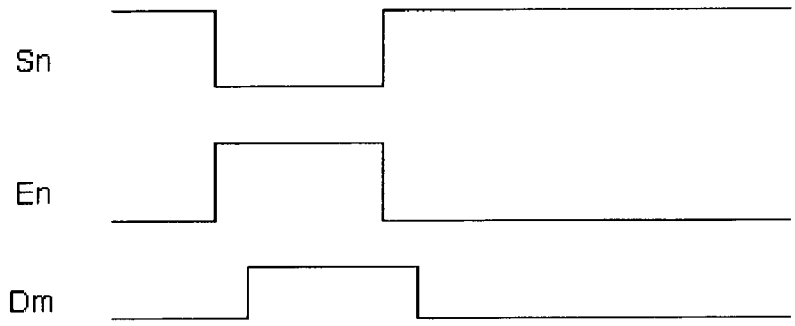
FIGS. 7, 10, 14, 16, 18, 20, 24, and 26 respectively show driving waveform diagrams for driving the pixel circuit of FIGS. 6, 9, 13, 15, 17, 19, 23, and 25.

In this exemplary embodiment, the switches S1, S2, and S3 include general switches, and they may further include transistors. Referring to FIGS. 6 and 7, an exemplary embodiment for realizing the switches S1, S2, and S3 as PMOS transistors will be described in detail.

FIG. 6 shows an equivalent circuit of a pixel circuit according to a second exemplary embodiment of the present invention, and FIG. 7 shows a driving waveform for driving the pixel circuit of FIG. 6.

As shown in FIG. 6, the pixel circuit has a structure matched with that of the first exemplary embodiment except the transistors M2, M3, and M4 are provided instead of the switches S1, S2, and S3 in the pixel circuit of FIG. 5. In this exemplary embodiment, the transistors M2, M3, and M4 are PMOS transistors, the gates of the transistors M2 and M3 are coupled to the scan line $S_n$, and the gate of the transistor M4 is coupled to the scan line $E_n$.

An operation of the pixel circuit of FIG. 6 will be described with reference to FIG. 7. When the transistors M2 and M3 are turned on because of the select signal with a low level voltage is applied through the scan line $S_n$, the transistor M1 is diode-connected, and the data current $I_{DATA}$ provided from the data line $D_m$ flows to the transistor M1. In this case, the gate-source voltage $V_{GS}$ at the transistor M1 and the current $I_{DATA}$ flowing to the transistor M1 satisfy Equation 3, and thus, the gate-source voltage $V_{GS}$ at the transistor M1 may be found from Equation 4.

Equation 3:

$$I_{DATA} = \frac{\beta}{2}(V_{GS} - V_{TH})^2$$

where β is a constant, and $V_{TH}$ is a threshold voltage at the transistor M1.

Equation 4:

$$V_{GS} = \sqrt{\frac{2I_{DATA}}{\beta}} + V_{TH}$$

When the select signal $S_n$ is a high level voltage, and the emit signal $E_n$ is a low level voltage, the transistors M2 and M3 are turned off, and the transistor M4 is turned on. When the select signal $S_n$ is switched to the high level voltage from the low level voltage, the voltage at a common node of the capacitor C2 and the scan line $S_n$ increases by a level rise height of the select signal $S_n$. Therefore, the gate voltage $V_G$ of the transistor M1 increases because of coupling of the capacitors C1 and C2, and the increment is expressed in Equation 5.

Equation 5:

$$\Delta V_G = \frac{\Delta V_S C_2}{C_1 + C_2}$$

where $C_1$ and $C_2$ are the capacitances of the capacitors C1 and C2, respectively.

In view of the increase in the gate voltage $V_G$ of the transistor M1, the current $I_{OLED}$ flowing to the transistor M1 is expressed in Equation 6. When the transistor M3 is turned on because of the emit signal $E_n$, the current $I_{OLED}$ of the transistor M1 is applied to the organic EL element OLED to emit light.

Equation 6:

$$I_{OLED} = \frac{\beta}{2}(V_{GS} - \Delta V_G - V_{TH})^2 = \frac{\beta}{2}\left(\sqrt{\frac{2I_{DATA}}{\beta}} - \Delta V_G\right)^2$$

By solving Equation 6 for the data current $I_{DATA}$, it can be seen that the data current $I_{DATA}$ may be set to be greater than the current $I_{OLED}$ flowing to the organic EL element OLED. That is, because the micro-current flowing to the organic EL element is controlled using the big data current $I_{DATA}$, a smaller amount of time for charging the data line is sufficient.

Equation 7:

$$I_{DATA} = I_{OLED} + \Delta V_G\sqrt{2\beta I_{OLED}} + \frac{\beta}{2}(\Delta V_G)^2$$

In the second exemplary embodiment, the transistor M2 is driven using the select signal $S_n$ from the scan line $S_n$, but a switching error by the transistor M2 may be generated when the rising time of the select signal $S_n$ is varied because of the load of the scan line. To reduce the influence of the switching error by the transistor M2, the select signal $S_n$ may be buffered and applied to the transistor M2, which will be described in detail with reference to FIG. 8.

Figure 8:
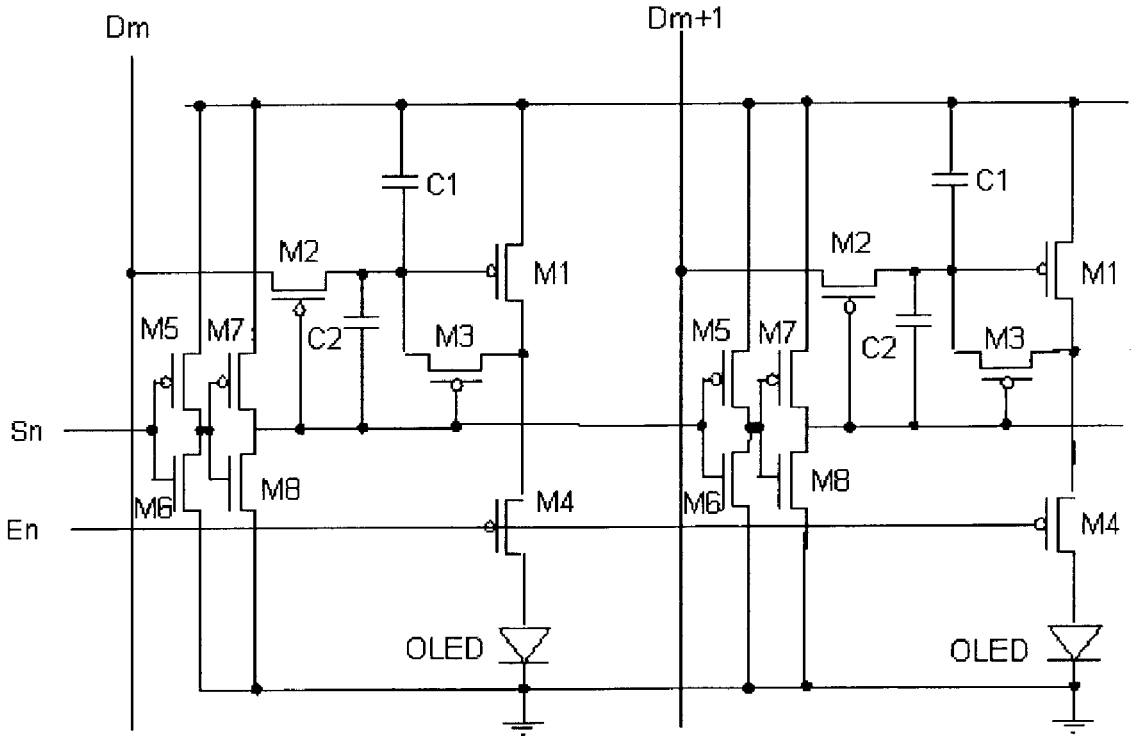

FIG. 8 shows a pixel circuit according to a third exemplary embodiment of the present invention. As shown, the pixel circuit according to the third exemplary embodiment has a similar structure as that of the first exemplary embodiment except for a buffer. The buffer includes four transistors M5–M8. Two of the transistors M5 and M7 are PMOS transistors, and the other two transistors M6 and M8 are NMOS transistors. The transistors M5 and M6 are coupled in series between the power supply voltage VDD and the reference voltage, and a common node of the transistors M5 and M6 is coupled to the gates of the transistors M7 and M8. A select signal of the $(m-1)^{th}$ pixel circuit is input to the gates of the transistors M5 and M6. The transistors M7 and M8 are coupled in series between the power supply voltage VDD and the reference voltage, and an output at the common node of the transistors M7 and M8 is applied as a select signal to the gates of the transistors M2 and M3.

As to an operation of the buffer, when the select signal input to the gates of the transistors M5 and M6 is a high level voltage, the transistor M6 is turned on, and the signal at a low level voltage is input to the gates of the transistors M7 and M8 according to the reference voltage. The transistor M7 is turned on according to the signal at a low level voltage, and the signal at a high level voltage is applied as a select signal to the gates of the transistors M2 and M3 according to the power supply voltage VDD. When the select signal input to the gates of the transistors M5 and M6 is a low level voltage, the transistor M5 is turned on, and the signal at a high level signal is input to the gates of the transistors M7 and M8 according to the power supply voltage VDD. The transistor M8 is turned on according to the signal at a high level voltage, and the signal at a low level voltage is applied as a select signal to the gates of the transistors M2 an M3 according to the reference voltage. By using the buffer, the rising time of the select signal at all the pixels becomes substantially, and possibly completely, identical, thereby reducing an influence of switching errors of the transistor M2.

In this exemplary embodiment of the present invention, four transistors are employed to configure a buffer. However, it should be understood by one skilled in the art at the time of the invention that other types of buffers may also be used without being restricted to the third embodiment.

In the first through third exemplary embodiments, an additional scan line $E_n$ for transmitting the emit signal $E_n$ is used to control the driving of the switch S3 and/or the transistor M4. However, the driving of the switch S3 or the transistor M4 may be controlled using the select signal $S_n$ from the scan line $S_n$ without using the additional scan line $E_n$, which will be described in detail with reference to FIGS. 9 and 10.

Figure 9:
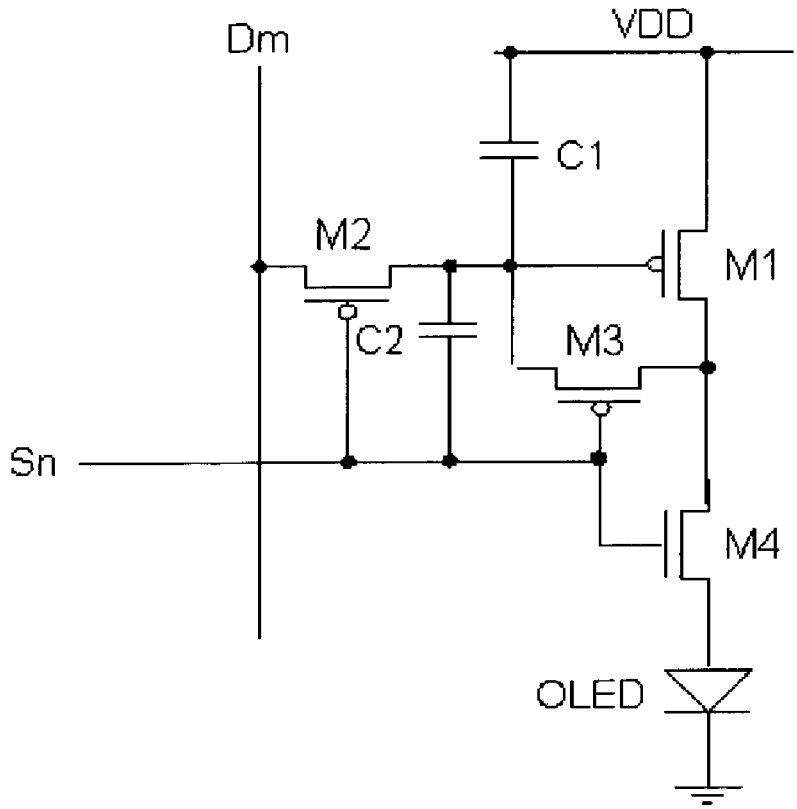
Figure 10:
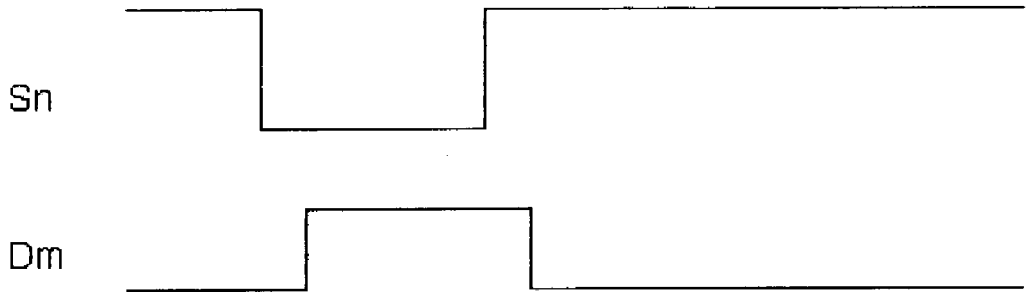

FIG. 9 shows a pixel circuit according to a fourth exemplary embodiment of the present invention, and FIG. 10 shows a driving waveform for driving the pixel circuit of FIG. 9.

As shown in FIG. 9, the pixel circuit according to the fourth exemplary embodiment has a similar structure as that of the pixel circuit of FIG. 6, except that a scan line $E_n$ is not provided and the type and coupling state of the transistor M4 are different. The transistor M4 is an NMOS transistor, and the gate of the transistor M3 is coupled to the scan line $S_n$ rather than the scan line $E_n$. As shown in FIG. 10, when the select signal $S_n$ becomes a high level voltage, the transistor M4 is turned on, and the current $I_{OLED}$ output from the transistor M1 is transmitted to the organic EL element.

In this embodiment, because the transistor M4 with the NMOS transistor requires no additional wire for transmitting the emit signal, the aperture ratio of the pixel is increased.

In the first through fourth exemplary embodiments of the present invention, the transistor M3 is coupled between the drain and the gate of the transistor M1, thereby, diode-connecting the transistor M1. In various embodiments of the present invention, it is possible for the transistor M3 to be coupled between the drain of the transistor M1 and the data line $D_m$. This arrangement will be described in detail with reference to FIGS. 11 and 12.

Figure 11:
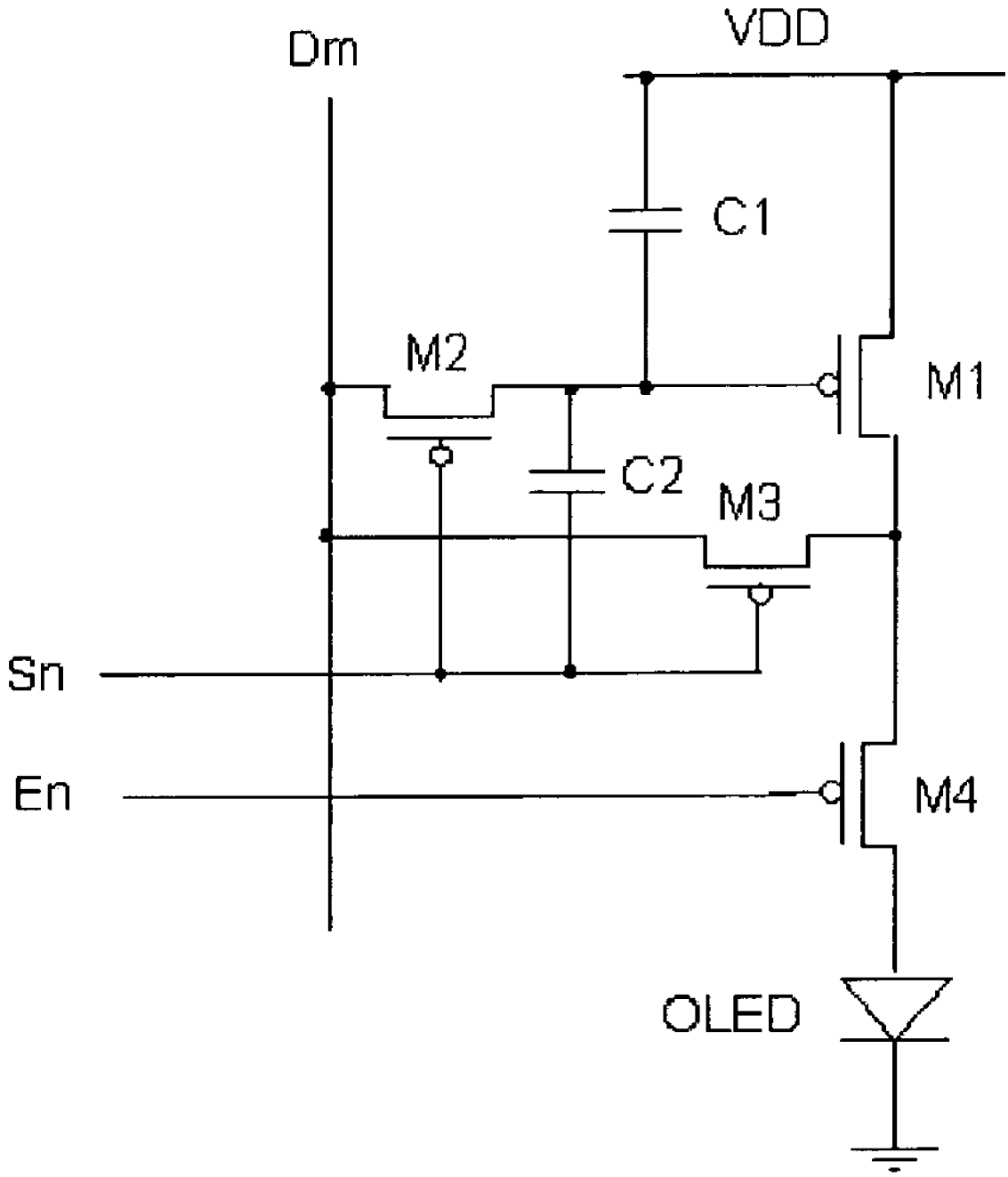
Figure 12:
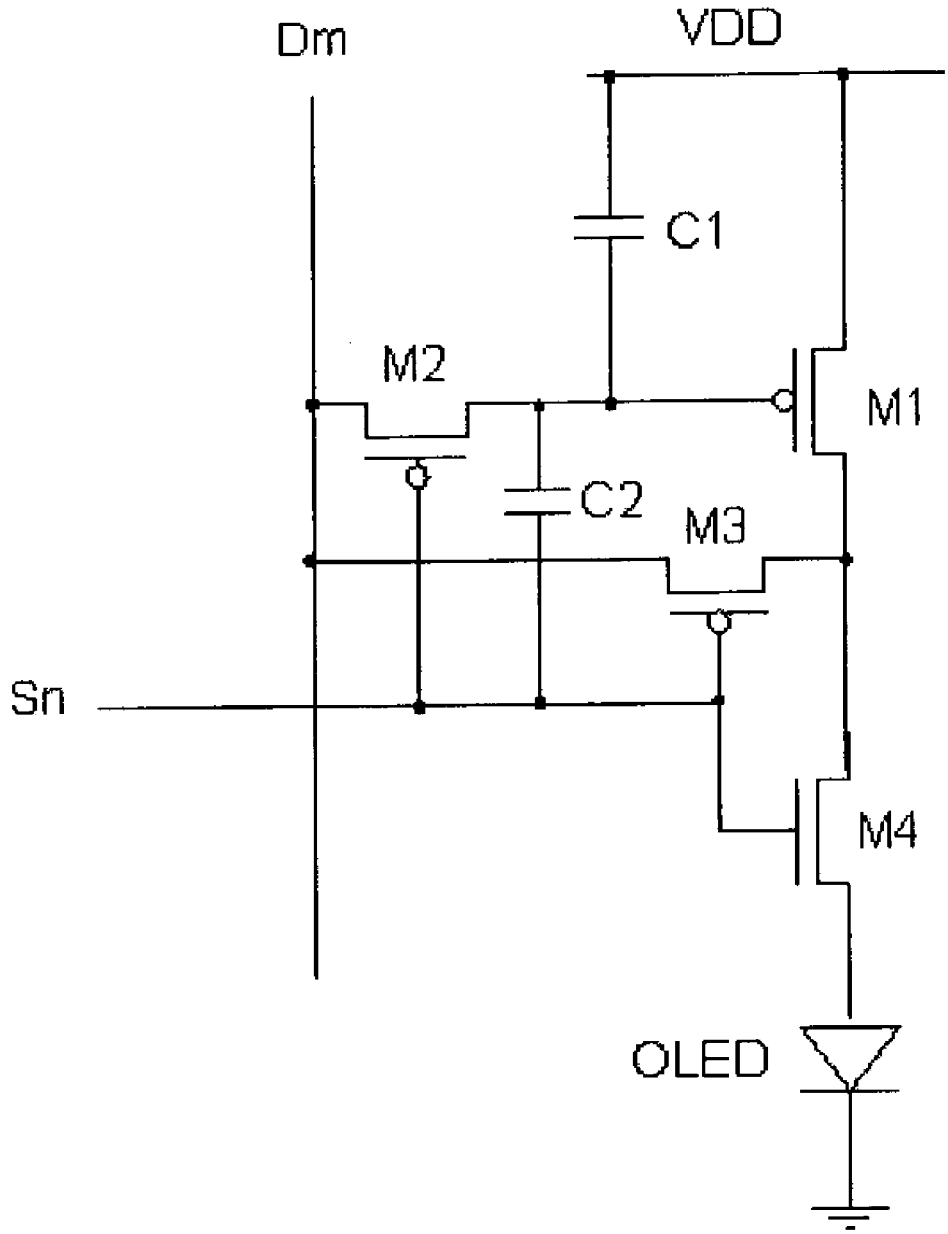

FIGS. 11 and 12 respectively show a pixel circuit according to fifth and sixth exemplary embodiments of the present invention.

As shown in FIG. 11, the pixel circuit according to the fifth exemplary embodiment has a similar structure as that of the pixel circuit of FIG. 6 except for the coupling state of the transistor M3. In this embodiment, the transistor M3 is coupled between the data line $D_m$ and the drain of the transistor M1, and it drives the pixel circuit using the driving waveform of FIG. 7. When the select signal $S_n$ from the scan line $S_n$ is a low level voltage, the transistors M2 and M3 are concurrently turned on, and accordingly, the gate and the drain of the transistor M1 are coupled. That is, similar to the pixel circuit of FIG. 6, the transistor M1 is diode-connected when the select signal $S_n$ is a low level voltage.

When the transistor M3 is coupled between the gate and the drain of the transistor M1 in the like manner shown in FIG. 6, the voltage at the gate of the transistor M1 may be influenced when the transistor M3 is turned off. When the transistor M3 is coupled to the data line $D_m$ in the like manner of the fifth exemplary embodiment, the gate voltage of the transistor M1 is less influenced when the transistor M3 is turned off.

Referring to FIG. 12, the pixel circuit according to a sixth exemplary embodiment has a structure similar to the pixel circuit of FIG. 9 except that the transistor M3 is coupled between the data line $D_m$ and the drain of the transistor M1.

In the first through sixth exemplary embodiments, the scan line $S_n$ is coupled to the gates of the transistors M2 and M3. However, it is possible for the scan line $S_n$ to only be coupled to the gate of the transistor M2. This arrangement will be described in detail with reference to FIGS. 13 through 16.

Figure 13:
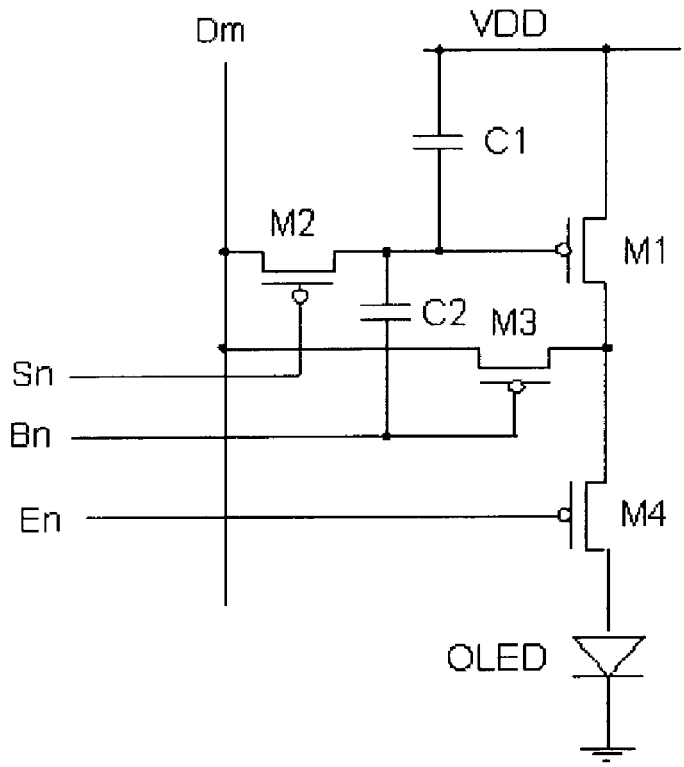
Figure 14:
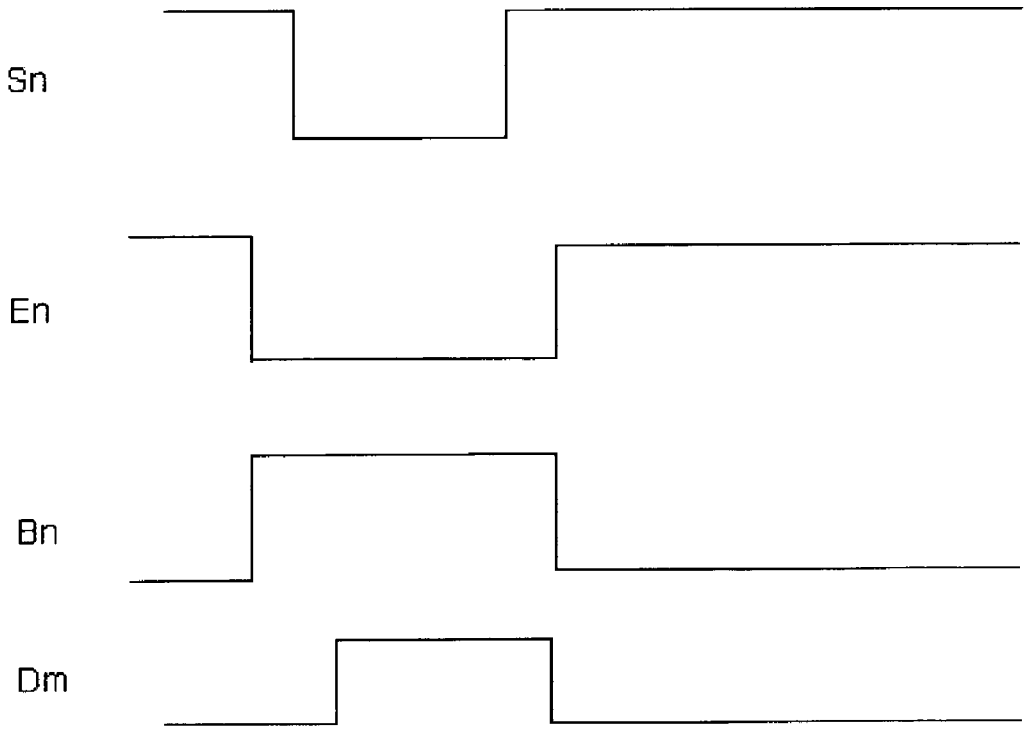
Figure 15:
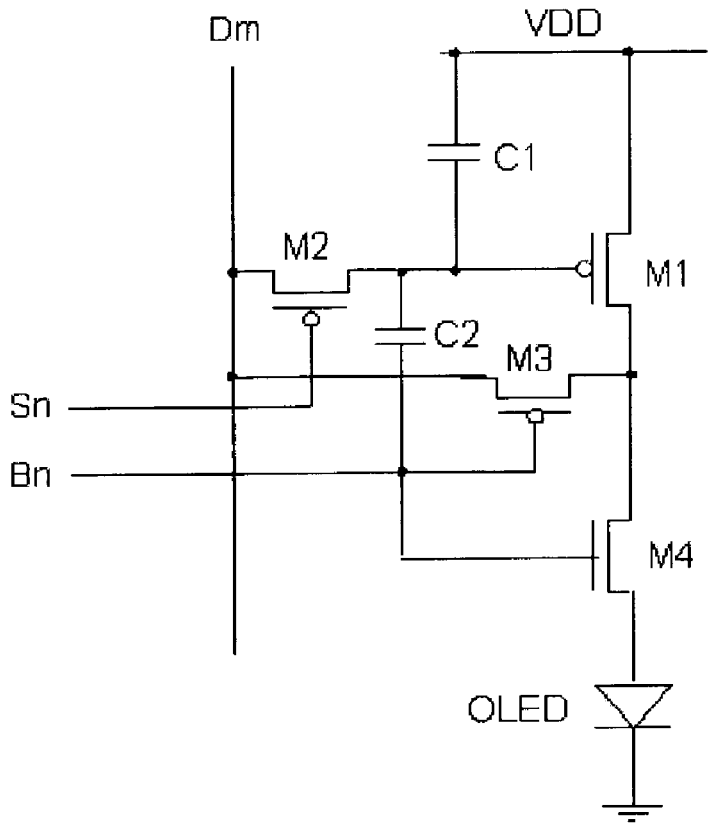
Figure 16:
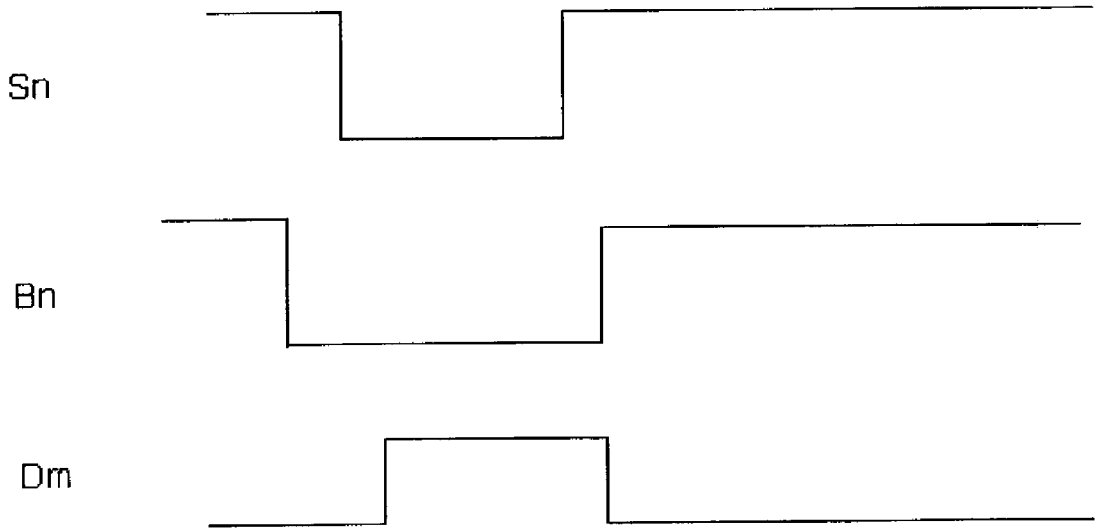

FIGS. 13 and 15 respectively show a pixel circuit according to seventh and eighth exemplary embodiments of the present invention, and FIGS. 14 and 16 respectively show a driving waveform diagram for driving the pixel circuits of FIGS. 13 and 15.

As shown in FIG. 13, the pixel circuit according to the seventh exemplary embodiment has a similar structure as that of the pixel circuit of FIG. 6 except for the coupling state of the transistor M3 and the capacitor C2. The gate of the transistor M3 is coupled to an additional scan line $B_n$, and the capacitor C2 is coupled between the gate of the transistor M1 and the scan line $B_n$.

Referring to FIG. 14, a boost signal $B_n$ from the scan line $B_n$ becomes a low level voltage before the select signal $S_n$ becomes a low level voltage, and it becomes a high level voltage after the select signal $S_n$ becomes a high level voltage. When the transistor M2 is turned off, a voltage at a common node of the capacitor C2 and the scan line $B_n$ increases by the level rising height of the boost signal $B_n$. Therefore, the gate voltage $V_G$ of the transistor M1 increases by the increment of Equation 5 according to the coupling of the capacitors C1 and C2, and the current $I_{OLED}$ of Equation 7 is applied to the organic EL element OLED. The other operations of the pixel circuit of FIG. 13 are matched with those of the pixel circuit of FIG. 6.

In the seventh exemplary embodiment where the scan line $S_n$ is coupled only to the gate of the transistor M2 to reduce the load of the scan line $S_n$, the rising time of the select signal $S_n$ becomes uniform over the whole panel. Also, in the seventh exemplary embodiment, the influence of switching errors of the transistor M2 is reduced because the gate node of the transistor M2 is boosted after the transistor M2 is turned off.

Next, referring to FIG. 15, the scan line $E_n$ is removed from the pixel circuit of FIG. 13 and the gate of the transistor M4 is coupled to the scan line $B_n$ to thereby configure a pixel circuit according to the eighth exemplary embodiment. In this exemplary embodiment, the transistor M4 is an NMOS transistor, that is, the transistor M4 is an opposite type of the transistor in relation to transistor M3.

As shown in FIG. 16, for the driving waveform for driving the pixel circuit of FIG. 15, the emit signal $E_n$ is removed from the driving waveform of FIG. 14. When the boost signal $B_n$ becomes a high level voltage to boost the gate voltage of the transistor M2, the transistor M4 is turned on. Therefore, the gate voltage of the transistor M2 is boosted, and accordingly, the current $I_{OLED}$ output from the transistor M1 is applied to the organic EL element OLED to emit light.

In the second through eighth exemplary embodiments, the transistors M1-M3 are PMOS transistors, but they may also be NMOS transistors, which will be described with reference to FIGS. 17 through 26.

FIGS. 17, 19, 21, 22, 23, and 25 respectively show an equivalent circuit diagram of a pixel circuit according to ninth through fourteenth exemplary embodiments, and FIGS. 18, 20, 24, and 26 respectively show a driving waveform for driving the pixel circuit of FIGS. 17, 19, 23, and 25.

Figure 17:
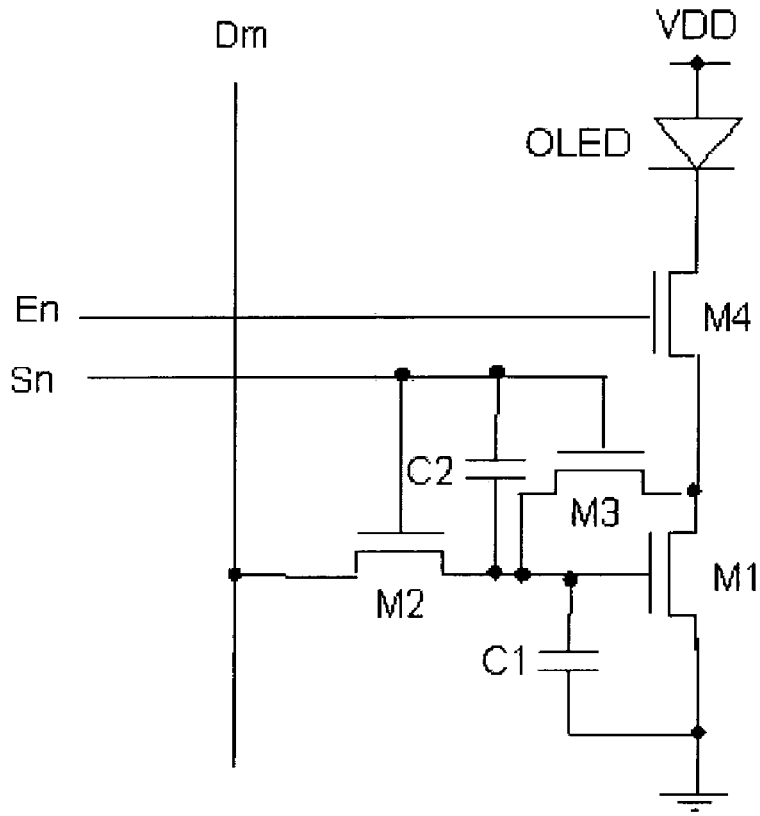

Referring to FIG. 17, the transistors M1–M4 are NMOS transistors in the ninth exemplary embodiment, and their coupling state is symmetric with the pixel circuit of FIG. 6. In detail, the transistor M2 is coupled between the data line $D_m$ and the gate of the transistor M1, and the gate thereof being coupled to the scan line $S_n$. The transistor M3 is coupled between the drain and the gate of the transistor M1, and the gate thereof being coupled to the scan line $S_n$. The source of the transistor M1 is coupled to the reference voltage, and the drain thereof is coupled to the organic EL element OLED. The capacitor C1 is coupled between the gate and the source of the transistor M1, and the organic EL element is coupled between the transistor M4 and the power supply voltage VDD. The gate of the transistor M4 is coupled to the scan line $E_n$.

Figure 18:
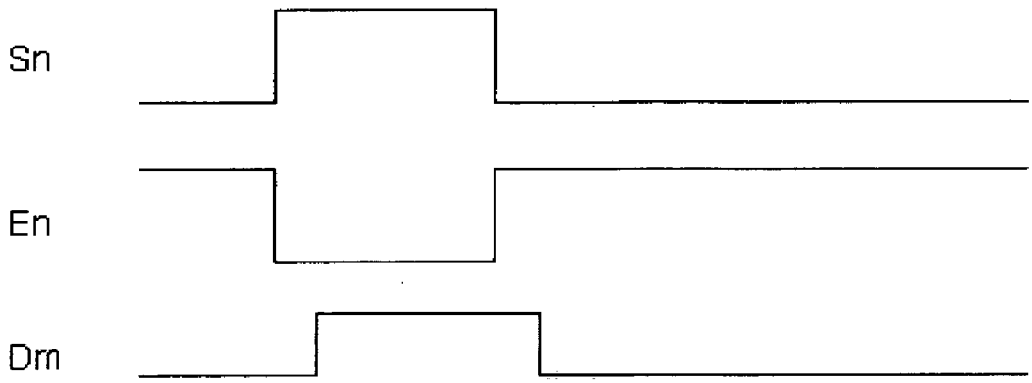

Since the transistors M2, M3, and M4 are NMOS transistors, the select signal $S_n$ and the emit signal $E_n$ for driving the pixel circuit of FIG. 17 have an inverse format of the signals $S_n$ and $E_n$ shown in FIG. 7, as shown in FIG. 18. Since a detailed operation of the pixel circuit of FIG. 17 may be easily understood from the description of the second exemplary embodiment, no further description will be provided.

Figure 19:
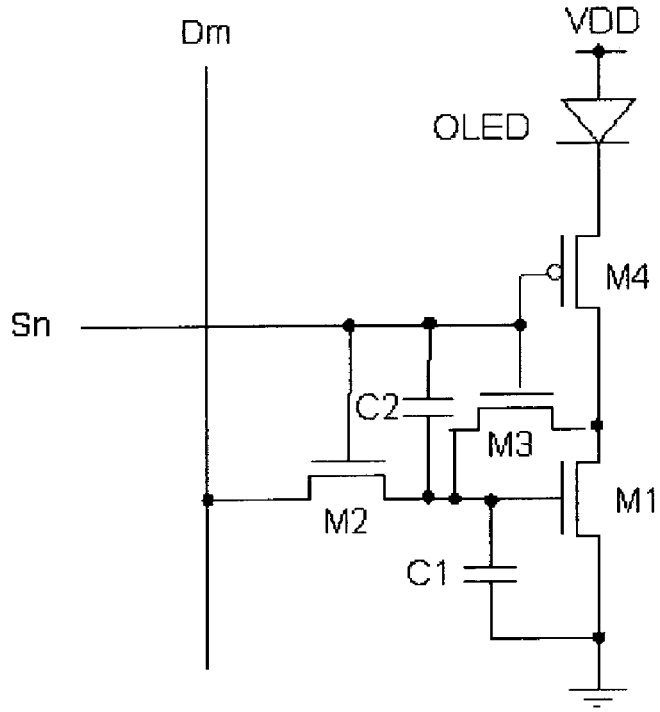
Figure 20:
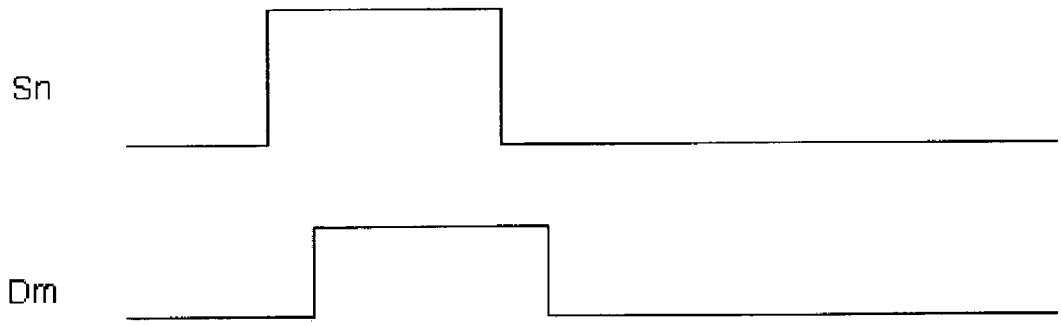

Next, referring to FIG. 19, in the pixel circuit according to a tenth exemplary embodiment, the transistors M1, M2, and M3 are NMOS transistors, the transistor M4 is a PMOS transistor, and their coupling state is symmetric with that of the pixel circuit of FIG. 9. Since the transistors M2 and M3 are NMOS transistors, and the transistor M4 is a PMOS transistor, the select signal $S_n$ for driving the transistors M2, M3, and M4 has an inverse format of the select signal $S_n$ of FIG. 10.

Figure 21:
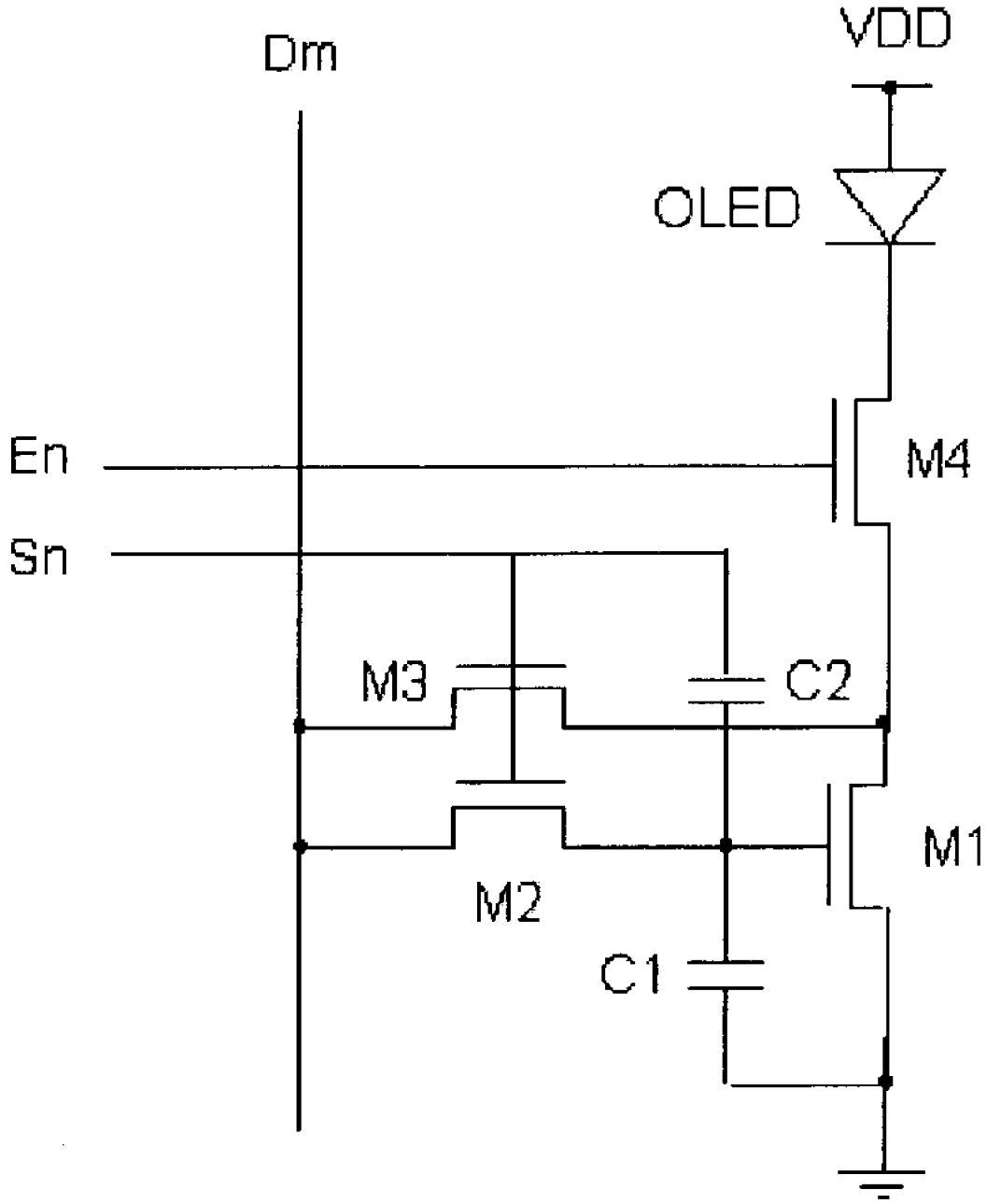
Figure 22:
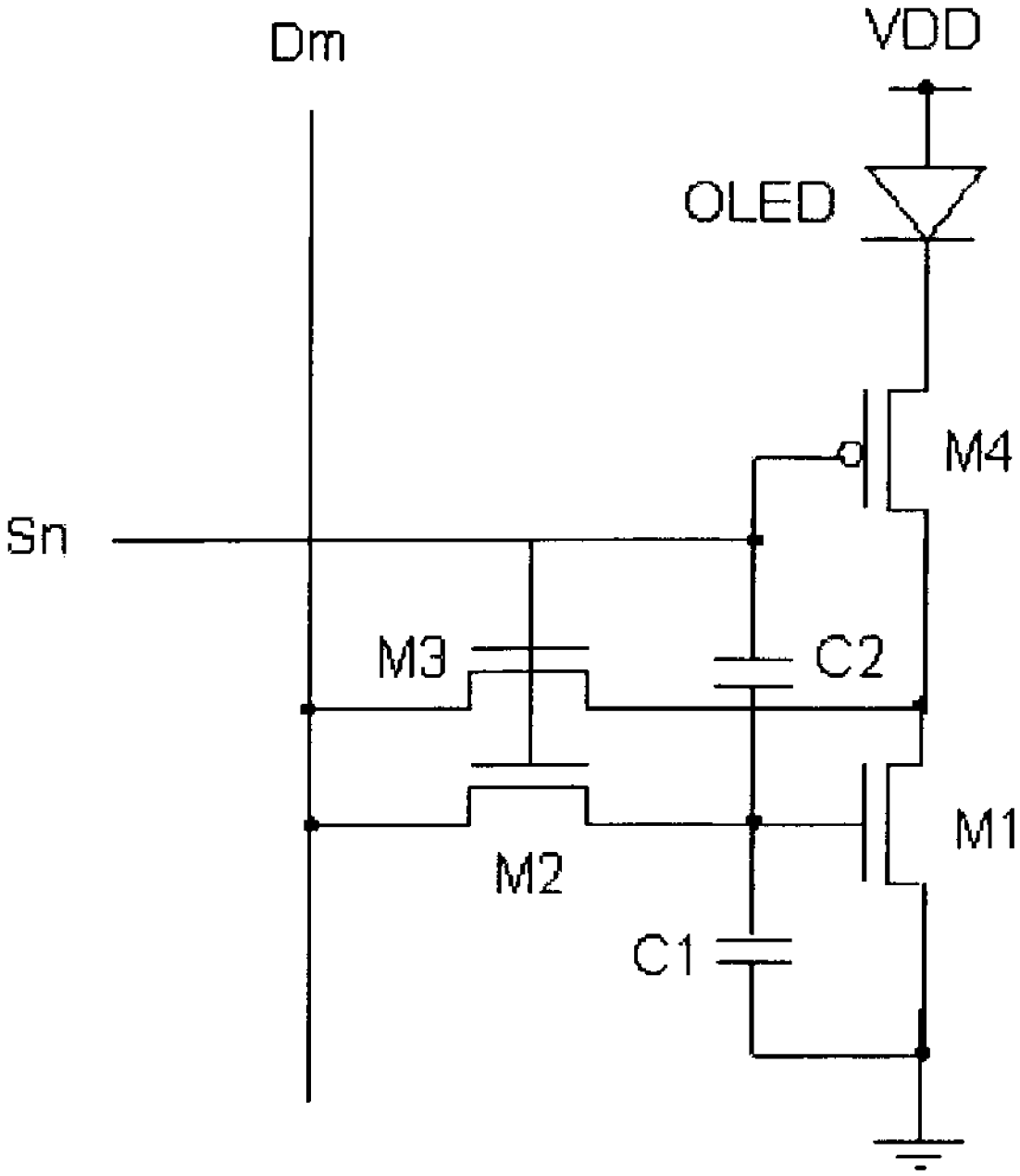

Referring to FIG. 21, in the pixel circuit according to an eleventh exemplary embodiment, NMOS transistors are used for the transistors M1–M4 of the pixel circuit of FIG. 11. Referring to FIG. 22, in the pixel circuit according to an twelfth exemplary embodiment, NMOS transistors are used for the transistors M1, M2, and M3, and a PMOS transistor is used for the transistor M4 in the pixel circuit of FIG. 12.

Figure 23:
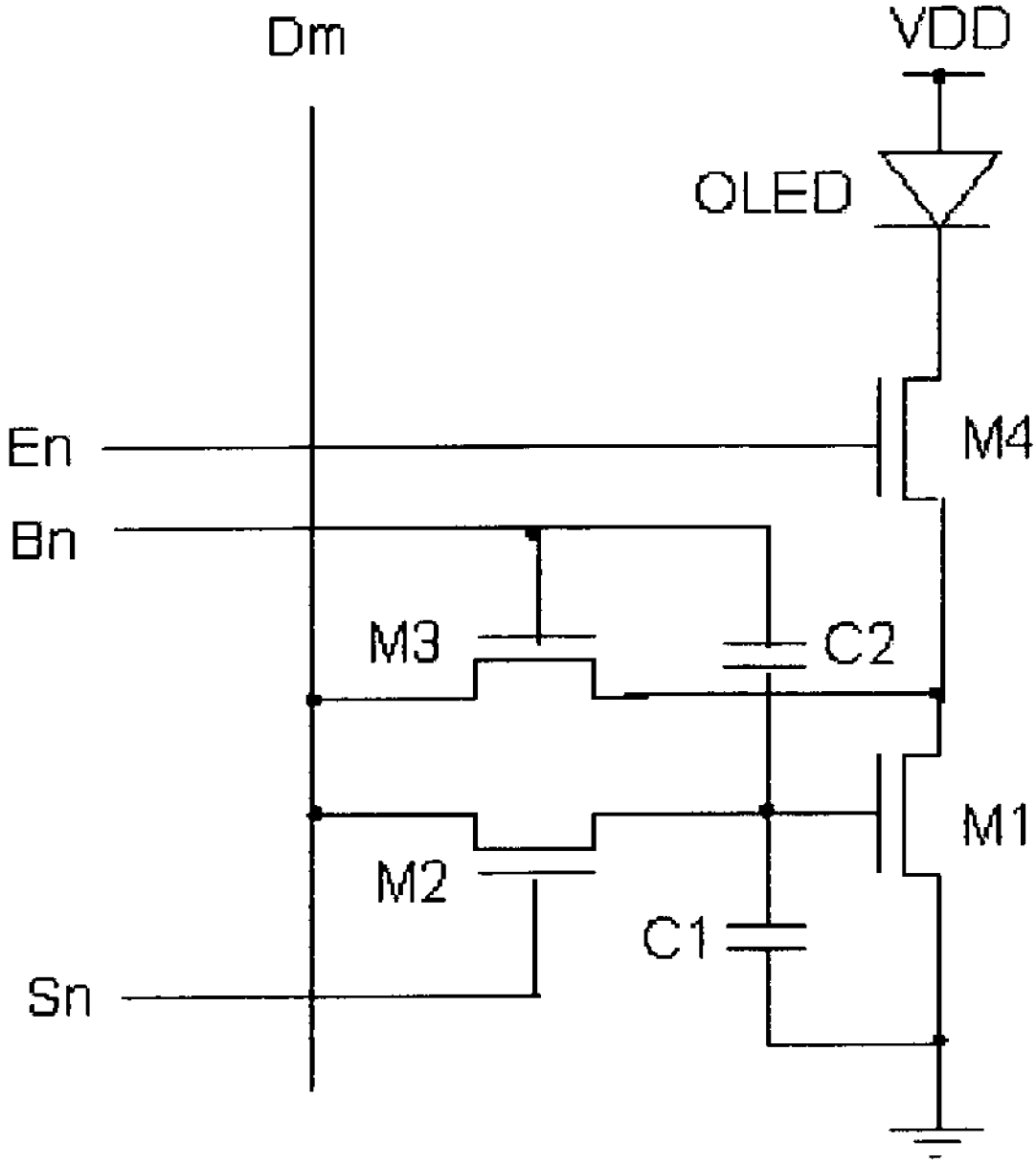
Figure 24:
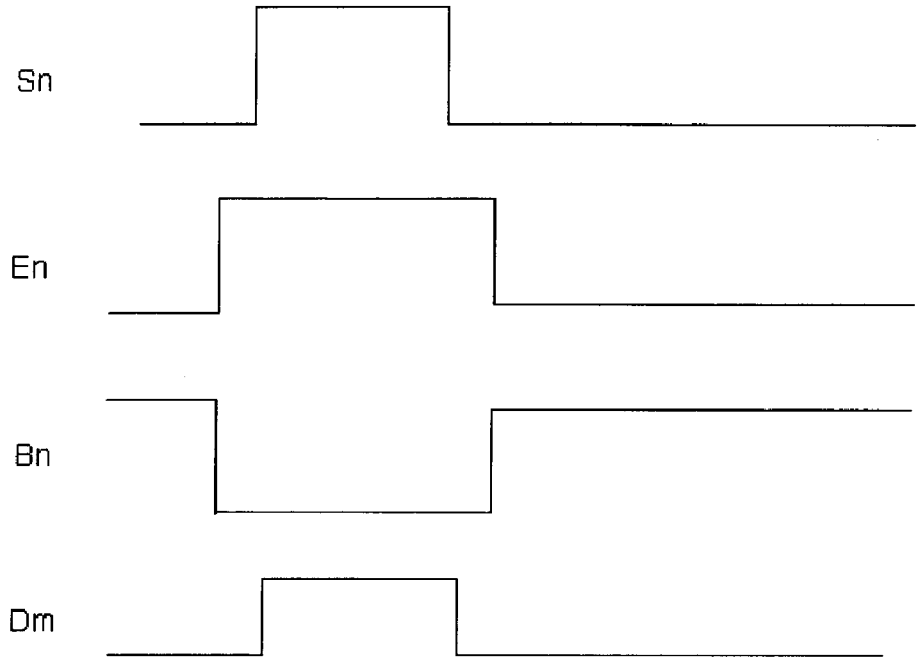

Referring to FIG. 23, in the pixel circuit according to a thirteenth exemplary embodiment, NMOS transistors are used for the transistors M1–M4 in the pixel circuit of FIG. 13. As shown in FIG. 24, the driving waveforms $S_n$, $B_n$, and $E_n$ for driving the pixel circuit of FIG. 23 respectively have an inverse format of those $S_n$, $B_n$, and $E_n$ of FIG. 14.

Figure 25:
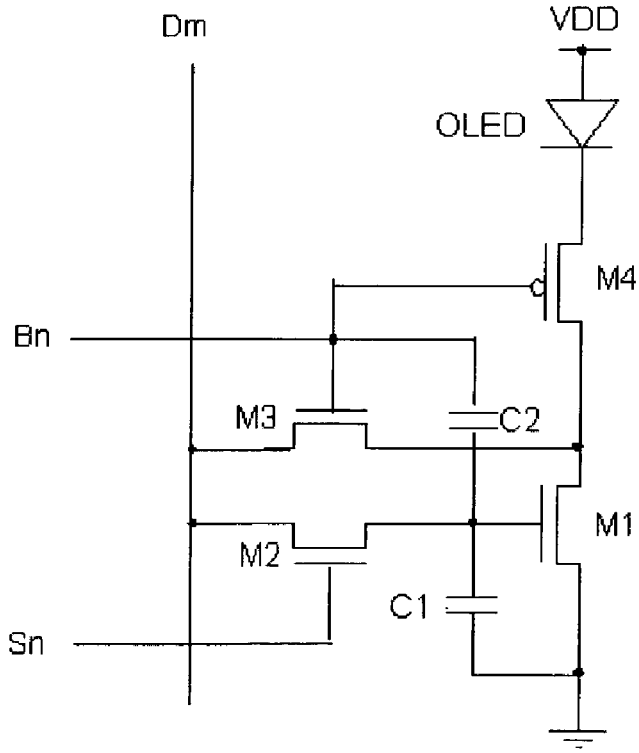
Figure 26:
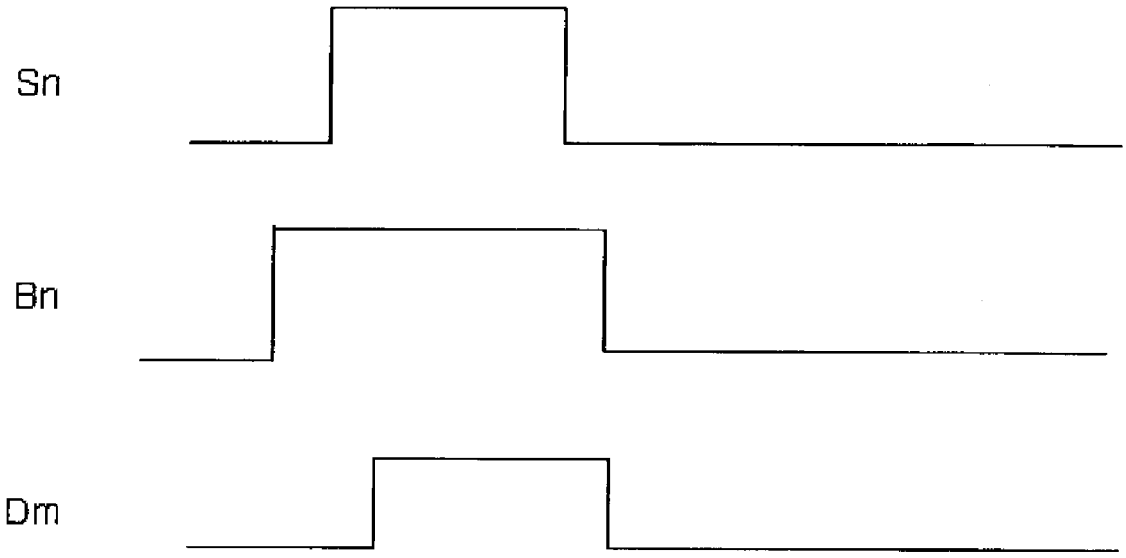

Referring to FIG. 25, in the pixel circuit according to a fourteenth exemplary embodiment, NMOS transistors are used for the transistors M1, M2, and M3, and a PMOS transistor is used for the transistor M4 in the pixel circuit of FIG. 15. As shown in FIG. 26, the driving waveforms $S_n$ and $B_n$ for driving the pixel circuit of FIG. 25 respectively have an inverse format of those $S_n$ and $B_n$ of FIG. 16.

In the above, the embodiments for using the NMOS transistors for the transistors M1, M2, and M3 have been described with reference to FIGS. 17 through 26. Since the pixel circuits and corresponding operations shown in FIGS. 17 through 26 are easily understood from the embodiments for using the PMOS transistors for them, no further description will be provided.

In the above-described exemplary embodiments PMOS or NMOS transistors are used for the transistors M1, M2, and M3, but without being restricted to them, a combination of PMOS and NMOS transistors or other switches which have similar functions may be used.

While this invention has been described in connection with what is presently considered to be the most practical and exemplary embodiment, it is to be understood that the invention is not limited to the disclosed embodiments, but, on the contrary, is intended to cover various modifications and equivalent arrangements included within the spirit and scope of the appended claims.

Since the current flowing to the organic EL element can be controlled using a large data current, the data line can be fully charged during a single line time frame. Further, deviations of threshold voltages of transistors and deviations of mobility are compensated in the current flowing to the organic EL element, and a light emitting display of high resolution and wide screen can be realized.

What is claimed is:

1. A light emitting display, comprising:

a data line for transmitting a data current that displays a video signal;

a light emitting element for emitting light based on an applied current;

a first transistor for supplying a driving current for emitting the light emitting element;

a first switching element for transmitting a data signal from the data line in response to the select signal from a scan line;

a second switching element for diode-connecting the first transistor in response to a first level of a first control signal;

a first storage element for storing a first voltage corresponding to the data current from the first switching element according to the first level of the first control signal;

a second storage element coupled between the first storage element and a signal line, and further coupled directly to the signal line, for supplying the first control signal, for converting the first voltage of the first storage element into a second voltage through coupling to the first storage element when the first level of the first control signal is switched to a second level; and a third switching element for transmitting the driving current to the light emitting element in response to the second control signal, the driving current being output from the first transistor according to the second voltage.

2. The light emitting display of claim 1, wherein the first storage element is coupled between a first main electrode of the first transistor and a control electrode of the first transistor, and the second storage element is coupled between the control electrode of the first transistor and the signal line.

3. The light emitting display of claim 1, wherein the second switching element is coupled between a second main electrode of the first transistor and the control electrode of the first transistor.

4. The light emitting display of claim 1, wherein the second switching element is coupled between the data line and a second main electrode of the first transistor.

5. The light emitting display of claim 1, wherein the signal line is the scan line, and the first control signal is the select signal.

6. The light emitting display of claim 5, wherein the second control signal is the select signal, and the third switching element responds to a disable level of the select signal.

7. The light emitting display of claim 6, wherein the second switching element is a first type of conductive transistor, and the third switching element is a second type of conductive transistor.

8. The light emitting display of claim 1, wherein the signal line for supplying the first control signal is other than the scan line, and the first level of the first control signal is switched to the second level when the select signal becomes a disable level.

9. The light emitting display of claim 8, wherein the second control signal is the first control signal, and the third switching element responds to a second level of the second control signal.

10. The light emitting display of claim 9, wherein the second switching element is a first type of conductive transistor, and the third switching element is a second type of conductive transistor.

11. The light emitting display of claim 1, wherein the first switching element, the second switching element and the third switching elements and the first transistor are the same conductive-type transistors.

12. The light emitting display of claim 1, further comprising a buffer for buffering the select signal and transmitting it to the first switching element.

13. A method for driving a light emitting display having a pixel circuit including a first switching element for transmitting a data current from a data line in response to a select signal from a scan line, a transistor for outputting a driving current, a first storage element coupled between a first main electrode of the transistor and a control electrode of the transistor, and a light emitting element for emitting light in correspondence to the driving current from the transistor, the method comprising:

diode-connecting the transistor using a control signal at a first level, and setting a control electrode voltage of the transistor as a first voltage in correspondence to the data current from the first switching element;

interrupting the data current, applying the control signal at a second level to a second end of a second storage element having the second end coupled directly to a first signal line and a first end coupled to a control electrode of the transistor, and changing the control electrode voltage of the transistor to a second voltage through coupling of the first and second storage elements; and applying the driving current output from the transistor to the light emitting element in response to the second voltage.

14. The method of claim 13, wherein the control signal is matched with the select signal.

15. The method of claim 13, wherein the control signal is changed to the second level when the select signal becomes a disable level.

16. The method of claim 13, wherein the pixel circuit further comprises a second switching element for transmitting a driving current from the transistor to the light emitting element in response to a control signal at the second level.

17. A display panel of a light emitting display, comprising:

a data line for transmitting a data current for displaying a video signal;

a scan line for transmitting a select signal;

a light emitting element for emitting light in correspondence to an applied current;

a first transistor, having a first main electrode coupled to a first signal line for supplying a power supply voltage, for outputting a current for driving the light emitting element;

a first switching element for transmitting a data current from the data line to the first transistor in response to the select signal from the scan line;

a second switching element for diode-connecting the first transistor in response to a first level of a first control signal;

a third switching element for transmitting a driving current from the transistor to the light emitting element in response to a second control signal;

a first storage element coupled between a control electrode of the first transistor and a first main electrode of the first transistor; and a second storage element coupled between the control electrode of the first transistor and a second signal line, and further coupled directly to the second signal line, for supplying the first control signal.

18. The display panel of claim 17, wherein the display panel operates in a first interval in which the first transistor is diode-connected by the first control signal at the first level, and the data current is transmitted to the first transistor by the select signal, and a second interval in which the data current is interrupted, the first control signal is changed to a second level, a level variation of the first control signal is reflected to the control electrode of the first transistor according to coupling by the first storage element and the second storage element, and the driving current is transmitted to the light emitting element by the second control signal.

19. The display panel of claim 18, wherein the second signal line is the scan line, and the first control signal is the select signal.

20. The display panel of claim 18, wherein the second signal line is other than the scan line, and the first control signal becomes the second level when the select signal becomes a disable level.

21. The display panel of claim 18, wherein the second control signal is matched with the first control signal, the second switching element are a first type of conductive transistor, and the third switching element is a second type of conductive transistor.

* * * * *